United States Patent [19]

Prince

[11] 4,319,361

[45] Mar. 16, 1982

[54] ONE STEP BINDING TAPE

[75] Inventor: Bruce A. Prince, Harrison, N.Y.

[73] Assignee: The Prince Group, Inc., New York, N.Y.

[21] Appl. No.: 92,998

[22] Filed: Nov. 9, 1979

[51] Int. Cl.[3] ..... A41D 27/00

[52] U.S. Cl. ..... 2/274; 2/236; 112/417

[58] Field of Search ..... 112/418, 417; 2/274, 2/236, 237; 428/192

[56] References Cited

U.S. PATENT DOCUMENTS 3,101,717 8/1963 Korman ..... 2/274 X

FOREIGN PATENT DOCUMENTS 745315 7/1970 Belgium ..... 112/418

372126 5/1932 United Kingdom ..... 2/274

*Primary Examiner*—H. Hampton Hunter

*Attorney, Agent, or Firm*—McAulay, Fields, Fisher, Goldstein & Nissen

[57] ABSTRACT

Bias binding tape for one step sewing to the edge of the material to be trimmed, is formed as a single unit with a front tape portion, a rear tape portion and a base portion. The front and rear portions extend from the base portion in substantially the same direction to form legs of a bifurcated envelope which receives the material to be trimmed. In this way, both the front and rear portions may be sewn to the material at the same time, without the need for pinning or otherwise aligning two separate portions, or separate sewing of a front and a rear piece of bias tape. The base portion may include ruffles or other decorative trim as desired.

3 Claims, 2 Drawing Figures

ONE STEP BINDING TAPE

BACKGROUND OF THE INVENTION

The present invention relates to a binding tape for trimming various items made of cloth or other materials.

More particularly, the present invention relates to bias binding tape especially for use by persons making their own garments, draperies, or other items in their homes under non-commercial conditions. The present invention can, of course, be used for commercial operations as well.

Bias binding tape, that is, a strip of material cut at an angle, normally 45°, to its "cross-grain" or direction of the threads used in its weaving, for use as trimming along the edge of fabric garments and other items, is well known and has been used for a long time in both commercial and non-commercial manufacturing operations. Basically, bias binding tape is sewn to the front, and sometimes the rear, side of the material to be trimmed, along the edges thereof. As the bias binding tape is cut at an angle or bias it can stretch or twist to follow curved edges without puckering.

In order to use prior bias binding tapes, a piece of tape is fitted and pinned to the front of the garment along an edge, with a piece of ruffle or other decoration to be secured along the same edge. The front binding tape and the ruffle or other decoration is then sewn to the material to be trimmed. If a back bias tape is also to be applied, this can be pinned to the materal at the same time or sewn on in a separate step. For less skilled sewers, a second step is often preferred in order to prevent the rear binding tape from slipping and not being properly secured. Even skilled sewers often find a separate sewing step for the rear binding worth the extra effort, especially when the edge to which the binding is to be sewn, is one with which it is difficult to work.

Alternatively, to save the bother of applying the rear binding tape, it is omitted entirely. This leaves the rear of the item unfinished. For some applications this is not overly objectional. However, a finished edge on both sides is always preferable and adds to the pride of accomplishment which persons making their own garments or other items often feel when the job is properly done.

It is therefore an object of the present invention to provide a bias binding tape which provides a finished edge on both the front and rear of the material to which it is being applied, in a one-step sewing process.

It is a further and related object of the invention to provide a bias binding tape wherein alignment of the front and rear portions is easily accomplished.

It is a still further object of the present invention to provide a bias binding tape wherein decorative ruffles are automatically properly aligned and applied with front and rear bias binding tape without the need for a still further alignment step.

BRIEF DESCRIPTION OF THE DISCLOSURE

Briefly, a bias binding tape according to the present invention provides, in a single structure, a front tape portion, a rear tape portion and a base portion. The base portion carries decorative ruffles or other decoration, as desired.

The front and rear tape portions extend generally in the same direction from the base portion and form the legs of a bifurcated envelope operable to receive the material to be trimmed. Once the material is received in the envelope, the binding tape structure is sewn in a single operation to the material. This applies both front and rear portion as well as any decorative trim, all of which are aligned at the same time in the same operation and secured to the material by a single sewing step.

DESCRIPTION OF THE PREFERRED EMBODIMENTS

Figure 1:
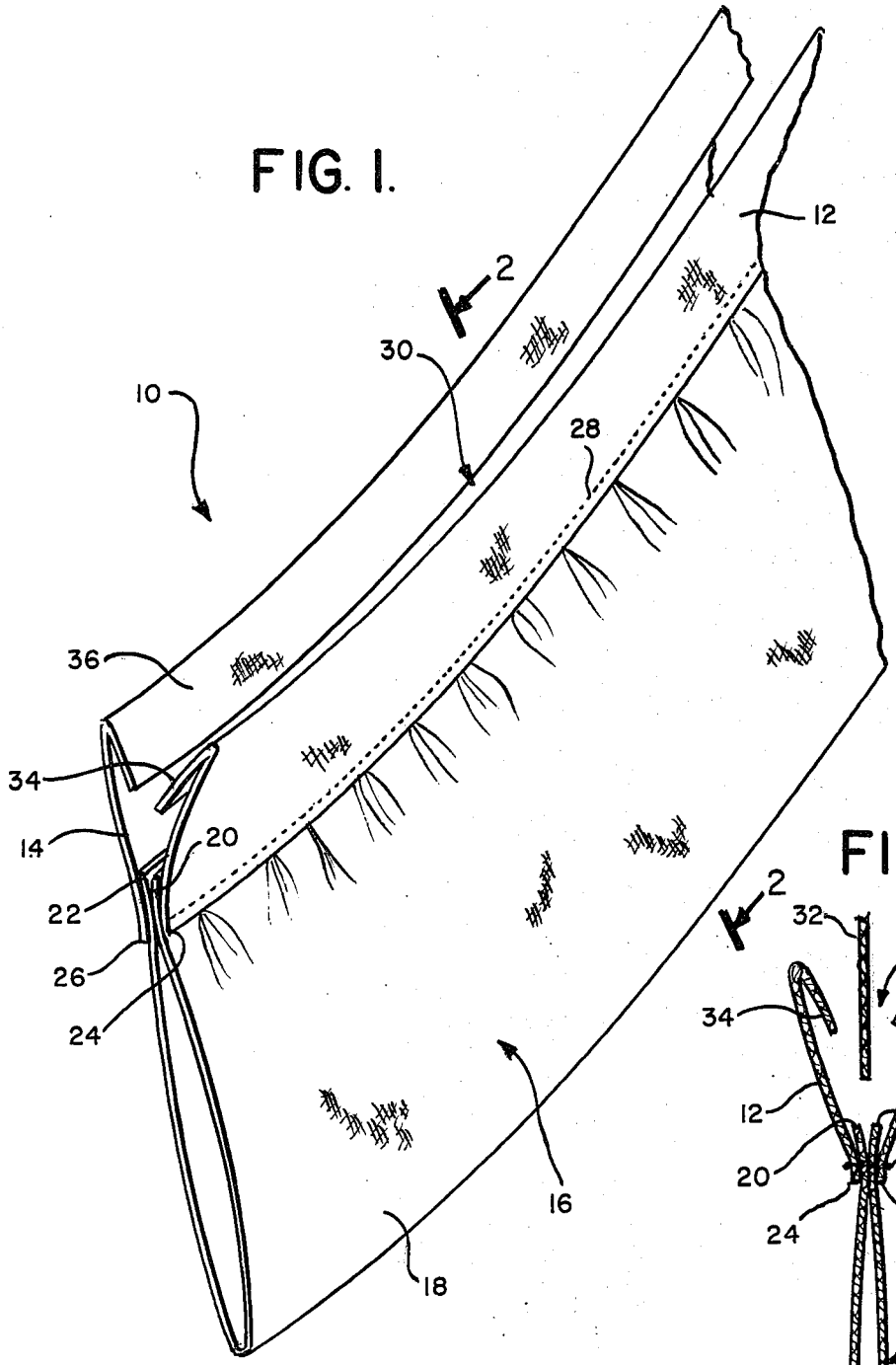
FIG. 1 is a perspective view of a portion of a strip of bias binding tape constructed according to the present invention, provided with decorative ruffles.

With reference to the drawings, a bias binding tape is formed as a single unit with a front tape portion 12, a rear tape portion 14 and base portion 16.

The base portion 16 may include decorative trim such as a strip of ruffle 18, preferably doubled over with its edges 20, 22 received between lower edges 24, 26 of front and rear portions, 12, 14 respectively. The base portion 16 and the front and rear tape portions, 12, 14 are all secured together near the overlap of the lower edges 12, 14 and ruffle edges 20, 22, preferably by a row of stitching 28.

Figure 2:
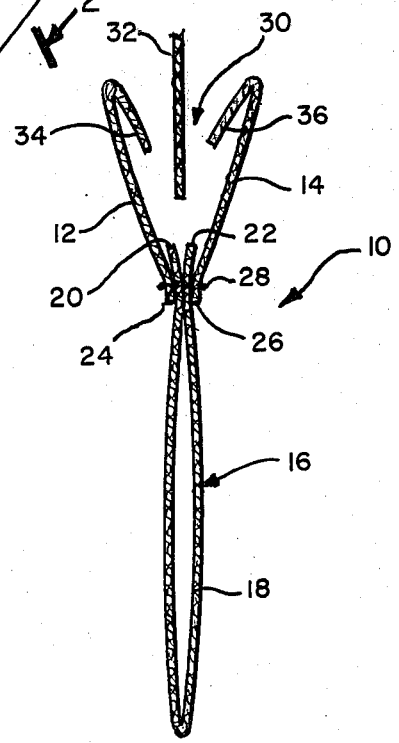
FIG. 2 is a sectional view thereof through the line 2—2 of FIG. 1, with a piece of material shown in place for sewing.

As can be seen in FIGS. 1 and 2, the front and rear tape portions 12, 14, are normally generally elongated rectangular strips of material which extend from their lower edges 24, 26 respectively upwardly in substantially the same direction from the base portion 16 and in facing relationship with respect to each other. With reference to FIG. 2, front and rear tape portions 12, 14 thereby form the leg of a bifurcated envelope 30 which receives the material 32 which is to be trimmed (FIG. 2). Material 32 has not been illustrated in FIG. 1 for clarity in showing the perspective view of FIG. 1.

In order to provide a sewing edge, upper edges 34, 36 of front and rear tape portions 12, 14 are preferably prefolded. Although, as shown in the drawings, front and rear tape portions 12, 14 are preferably identical in size and structure, if desired front portion upper edge 34 may be folded at a lower position than rear portion upper edge 36 so that less experienced sewers will need to worry less about possible slippage or misalignment of the front and rear portion 12, 14, when sewing.

It is also noted that front and rear portion 12, 14, can be made of different materials or of materials showing different patterns, if this is desired. Normally the material used to form the one-step bias binding tape is cloth fabric, cut on a bias, as is usual in the art. However, it is not intended that the present invention be restricted with respect to materials from which it is made, as other materials than those described herein can also be used. Thus, various polymeric materials, non-woven cloth fabrics and fabric strips cut other than on a "bias", can be used as required. Similarly, decorations other than ruffles, for example a strip of fringe, can be used, and the device assembled by means other than stitching 28.

In operation, the unitary bias binding tape construction of the present invention is attached to the edge of the material by inserting the edge into the area between the front and rear tape portions. It is then affixed in place by sewing a line of stitches or the like along the edge so that the stitches extend through the front and rear tapes, particularly in the folded-over area, and the material 32. In this manner, the tape of the present invention is quickly connected to the material in a one-step process thereby producing great savings in time and ease of application.

Thus, while a preferred embodiment of the invention has been shown and described herein it will become obvious that numerous omissions, changes and additions may be made herein without departing from spirit and scope of the present invention.

What is claimed is:

1. A binding tape for use by the home sewer and the like for a one-step alignment with and sewing to the edge of material to be trimmed, comprising:

a front tape portion comprising an elongated generally rectangular strip of fabric cut at a bias to the direction of the threads used for its weaving;

a rear tape portion comprising an elongated generally rectangular strip of fabric cut at a bias to the direction of the threads used for its weaving;

A base portion of decorative trim material folded over upon itself to form an open-ended trim;

said front and rear tape portions respectively having upper and lower elongated edges; the lower edges of said front and rear tape portions being in spaced relationship to the upper edges of said base portion on each side thereof whereby the lower portion of said front and rear tape portions are in face-to-face contact with the upper portion of a respective one of the panels forming said folded-over base portion; and at least one row of stitching extending through said front and rear and base portions to secure said portions together, whereby said front and rear tape portions extend upwardly from said base portion to form legs of a bifurcated envelope operable to receive therein the material to be trimmed; the upper edges of said front and rear tape portions being folded over in an inwardly direction to provide a reinforced sewing surface through which stitches may extend to secure together said binding tape and the material to be trimmed.

2. The binding tape of claim 1 wherein said fabric comprises cloth fabric cut at a 45° bias to the direction of the threads used for its weaving.

3. The binding tape of claim 1 wherein said decorative portion comprises a strip of ruffles.

* * * * *